United States Patent [19]

Sollinger et al.

[11] Patent Number: 4,936,942

[45] Date of Patent: Jun. 26, 1990

[54] SUCTION BOX FOR STABILIZING WEB AT CONNECTING POINT

[75] Inventors: Hans-Peter Sollinger, Heidenheim; Oswald Satzger, Giengen, both of Fed. Rep. of Germany

[73] Assignee: J.M. Voith GmbH, Fed. Rep. of Germany

[21] Appl. No.: 206,004

[22] Filed: Jun. 13, 1988

[30] Foreign Application Priority Data

Jun. 23, 1987 [DE] Fed. Rep. of Germany ..... 3720649

[51] Int. Cl.[5] ..... B65H 19/18; B65H 19/20

[52] U.S. Cl. ..... 156/504; 162/193; 162/352; 226/91; 226/198; 242/58.3; 242/58.5

[58] Field of Search ..... 156/504, 505; 242/58.1, 242/58.3, 58.5; 226/91, 196, 198; 162/193, 255, 286, 352, 374

[56] References Cited

U.S. PATENT DOCUMENTS

| | | | |
|---|---|---|---|
| 2,534,026 | 12/1950 | Hurxthal | 226/106 |
| 2,664,139 | 12/1953 | Speed et al. | 156/505 |
| 2,928,465 | 3/1960 | Wrist | 162/352 |
| 3,140,225 | 7/1964 | Truxa | 162/352 |
| 4,278,489 | 7/1981 | Horsley | 156/504 |
| 4,502,231 | 3/1985 | Fissman et al. | 34/114 |
| 4,726,502 | 2/1988 | Cryderman | 162/193 |

OTHER PUBLICATIONS

Voith Brochure, p. 2579e (Oct. 1987), pp. 22 and 24.

*Primary Examiner*—Michael Wityshyn
*Attorney, Agent, or Firm*—Ostrolenk, Faber, Gerb & Soffen

[57] ABSTRACT

Apparatus for stabilizing the trailing end of a web that is to be spliced to the leading end of a new web includes a knife for severing the old web and for creating a tail that must be stabilized, a suction box over which the trailing end passes, which provides stability to the trailing end, a pressure roll movable to move the cut trailing end of the old web against the leading end of the new web and a leaf-spring-like extension extending downstream of the suction box to the connection point or splice point between the webs. The extension is deflectable with the pressure roll and the extension carries the vacuum of the suction box further downstream and also supports the trailing end of the cut old web. The extension is cantilevered to the downstream side of the suction box.

16 Claims, 1 Drawing Sheet

SUCTION BOX FOR STABILIZING WEB AT CONNECTING POINT

BACKGROUND OF THE INVENTION

The invention relates to a suction box for stabilizing a web at a connection or splice position at which a new web is attached to a previous web, at a location upstream of a threading point where the web is threaded onto a roll. While use of this apparatus in a web coater is described, the apparatus has use in other applications.

In a coater for one or both sides of a web of paper, when one roll or supply of paper is exhausted and another roll or supply of paper is substituted, the trailing end of the exhausted roll and the leading end of the new roll must be spliced. Only a flying splice at full operating speed, which may be on the order of 1,500 m./min., guarantees high efficiency and best production rate. To accomplish this, both the old supply or roll of the web and the new supply or roll of the web to be coated must be delivering web the same speed, that is the web must be coming at the same speed. The old web must be severed cleanly to develop a tail to which the leading end of the new web might be spliced, and short effective splices between the two webs are needed.

For an effective splice, the trailing end of the recently cut web must be kept stable, and means are typically provided for achieving web stabilization. These means include the use of a suction generating means, such as a suction box, over which the web moves and which holds the web stable as it moves past. An example of an unwinding unit of an off-line coater in which the present invention might be used is shown in an informative brochure of the assignee hereof, namely Voith Brochure p2579e. Web stabilization through use of vacuum is known, as shown in U.S. Pat. No. 4,502,231.

For web stabilization, so called foils are also used on web splice equipment for connecting the ends of two webs, i.e. the foils are used with the suction boxes. The suction box stabilizes the web run by means of the vacuum in the box and by the surface of the box facing the web over which the web runs. In restricted space conditions, like that in the area of the pressure roll on its upstream side toward the new paper roll, the large distance between the slot point or nip of the pressure roll and the end of the suction box still causes web flutter. Such flutter results in crushing of the web and improper bonding of the old web to the new or else, in particular, it causes difficulties with later processes performed on the web, for example, in a succeeding coating unit.

SUMMARY OF THE INVENTION

The object of the invention is to improve web stabilization.

A further object is to extend the stabilizing support for the trailing end of a cut web downstream towards its splice position with the leading end of a new web.

The objects are achieved when a leaf-spring like extension of the suction box surface that is adjacent the web. That extension extends in the typically downstream direction, toward the connecting or splice point of the new web. The leaf-spring-shaped extension from the suction box transfers the vacuum forward or downstream far into the area of the splice point or the threading point or the connecting point or loading point of the pressure means that presses the webs together, e.g. a pressure roll, so that the web is guided very well up to that point and thereby extends the effective length of the suction box up toward the splice point.

Other objects and features of the invention are explained below with the aid of an embodiment shown in the drawings.

DESCRIPTION OF THE PREFERRED EMBODIMENT

Figure 1:
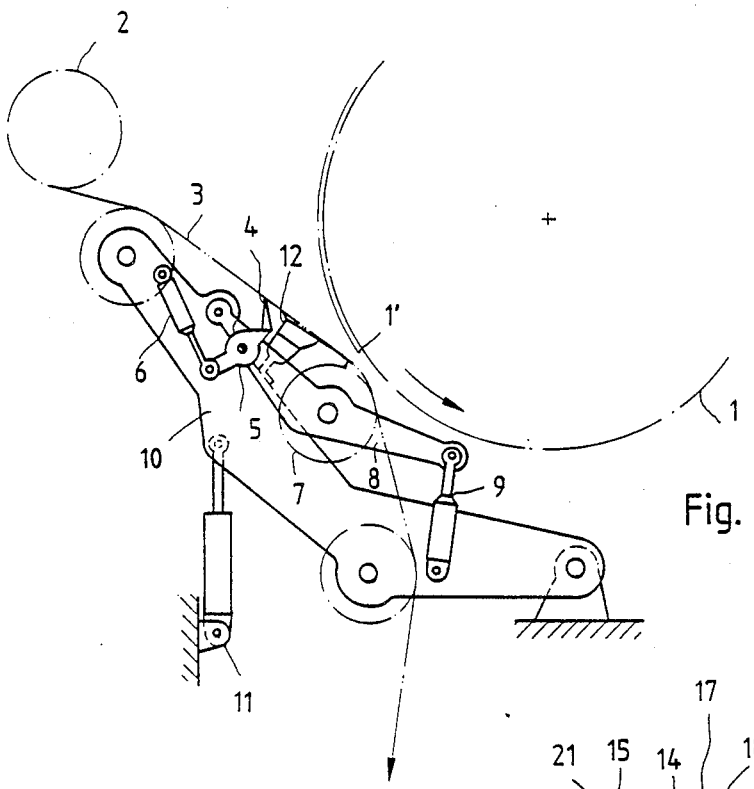
FIG. 1 is a basic view of the overall arrangement in which the invention is included.

In the simplified FIG. 1, there is a new paper roll 1, which has a web with a leading end 1' to be joined, and there is an old paper roll 2 with the terminating paper web having an exiting end 3 to be joined to the leading end 1'. There is a connecting point or splice point created by a pressure-applying means in the form of a pressure roll 7, where the end of the old web is bonded to the beginning of the new web. In the area of the connecting point, there is a suction box 12. The box 12 has a forward extension on which is supported the still further forwardly-extending leaf spring 13.

A separate knife 4 is located upstream of the connecting point. The knife 4 is supported on a swivelling lever 5. That lever is swivelled around its pivot in opposite directions, generally at right angles to the web 3, by means of pressure cylinder 6. In the same way, the pressure roller 7 is mounted to be swivelled around its pivot via lever 8 and pressure cylinder 9. The overall arrangement is located on the swivelling supporting beam 10, which is held by a swivelling bearing 11.

Figure 2:
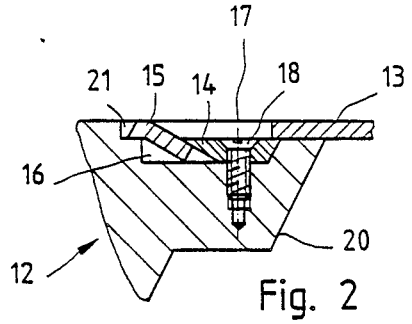
FIG. 2 is a detailed fragmentary sectional view through the end of the suction box, also showing the initial part of the leaf spring.

After the end of the paper web 3 has been separated by the separating knife 4, the trailing end of the web 3 is still moving toward the connecting point, but that end is now unsupported. The trailing end of the web 3 is stabilized by the suction box 12 acting in conjunction with the leaf spring 13. As shown in FIG. 2, the leaf spring is supported at a cantilever part 20 of the suction box 12. This support is provided by depressed tongues 15 and cooperating wedge pieces 14, which are fixed in a slot 16 of the cantilever part 20 by means of screws 18. The tongues are pressed out at an angle from the leaf spring. Screw 18 grips through an opening 17 formed at the tongue 15. This creates a positive fixing of the leaf spring 13 in the direction of its plane. A stop 21 is also provided at the cantilever piece 20 for the end of the leaf spring 13. The thickness of the leaf spring is preferably to be selected between 0.3 and 0.7 mm.

Figure 3:
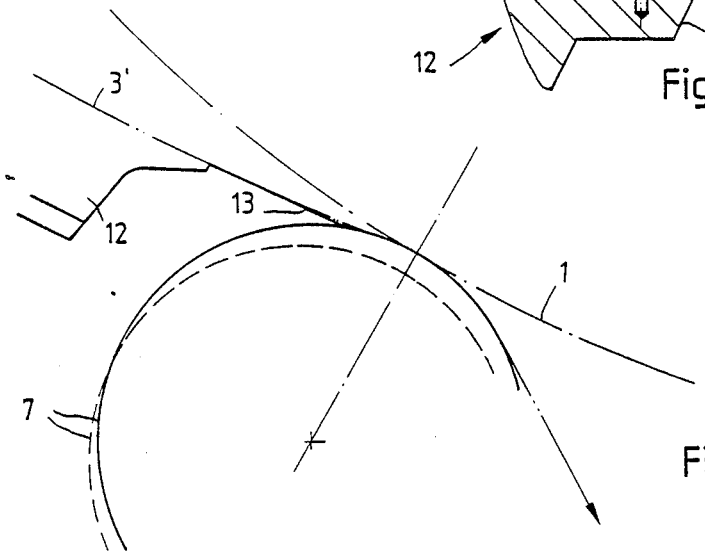
FIG. 3 is a detail showing the contact by the pressure roll.

In FIG. 3, the surface of the suction box 12 that faces the paper web 3 is extended by the leaf spring 13 to such an extent that bending of the leaf spring after connection of pressure roll 7, i.e. the pulled down, broken like position in FIG. 3 is at a maximum angle of 15°, with the leaf spring 13 then contacting the pressure roll 7. As shown, a deflection of a maximum angle of 5° is preferable. This means that the end of the leaf spring extension 13 would have to be arranged approximately 8 cm. upstream of the splice or connecting point, marked by the chain line in FIG. 3. Basically, there would then remain hardly any area in which the old paper web, and particularly the cut-off trailing end 3 of this web would not be guided, either by the suction box 12, or by the leaf spring extension or by the pressure roll 7. Further, the vacuum would virtually extend to the splice point due to the extension 13, so that proper guidance of the end of the old paper web is ensured, and so that its wrinkling is avoided.

The operation of the apparatus shown in FIG. 1 is now described. The web 3 is unwinding from the roll 2 and passes by the suction box 12 and extension 13 and past the pressure roll 7, and descends past an idler roll to a wind-up roll, not shown in FIG. 1. Normal full speed operation is on the order of 1,500 m./min. When the web 3 on the roll 2 is nearly exhausted, the pressure cylinder 6 is operated to raise the knife 4 to cut the web 3 and thereby form a trailing tail 3', defining a definite end of the web 3 that is unwinding from the roll 2. The tail 3' of the web is now unsupported and likely to flutter, and the invention is directed toward stabilizing that cut tail.

Meanwhile, the new roll 1 is in place above the pressure roll 7, as indicated in FIG. 1. It also has a leading end 1' which had been previously prepared with a binding agent, adhesive tape, or the like, for being secured to the tail 3' of the web 3. The tail 3' and the leading end 1' travel synchronously at the same speed and they are spliced when the pressure cylinder 9 rotates the pressure roller 7 toward the new roll 1, that is it moves the pressure roll 7 from the broken line position of FIG. 3 to the solid line position of FIG. 3. The web 1 is joined to the tail of the web 3 at the connecting point. Thereafter, the pressure cylinder moves the pressure roll 7 down away from the roll 1. During the above described process, it is important that the travel of the trailing tail 3' be carefully stabilized by means of the suction box 12 and by the yieldable leaf spring extension 13 which extends downstream to and even past the connecting point at roll 7 between the two webs. When the pressure roll 7 returns to its broken line position of FIG. 3, the leaf spring 13 travels with it and there is no longer pressure from either the roller or the leaf spring upon the web now continuing to unwind from the new roller 1. In accordance with usual practice, the new roller 1 is now gradually moved to a permanent supported position, such as the position previously occupied by the roller 2, and the roller 2 is expelled from that previous support position.

The device can, of course, be used for other application where, for example, a web is threaded onto a rotatable roll or even onto a web roller or a reel spool. It is particularly advantageous when there is a gap at the threading point, e.g. by a counter guide roller, even roll.

Should no counter guide roller or roll be available, the suction box is expediently arranged on the side of the web facing the web roller or guide roll, that is, the extension sheet is disposed in the nip between web roller or guide roll.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. Apparatus for stabilizing a moving web during splicing of an exhausted first web to a new second web, wherein the first web is being moved past the apparatus and the second web is in position to be moved past the apparatus, the apparatus comprising:

a knife positioned for cutting the first web as the first web moves past the apparatus, thereby creating a free trailing end of the first web;

web moving means for moving the trailing end of the moving first web into engagement with the leading end of the moving second web at a splice position on the apparatus for splicing them together at the splice position, and the splice position is located downstream of and spaced away from the position at which the knife cuts the first web;

suction means located along the path of the first web between the knife and the splice position over which the trailing end of the first web passes for drawing the first web toward the suction means and stabilizing the trailing end of the first web while it moves for subsequent splicing; the suction means comprising a surface adjacent the end of the web passing thereover on which the trailing end of the first web is stabilized; and a leaf-spring-like extension of the surface of the suction means extending downstream of the suction means toward the splice position, for extending the effective length of the suction means and extending the stabilization of the trailing end of the first web while it moves toward the splice point, the extension being deflectable toward the webs being spliced at the splice position as the web moving means move the webs together.

2. The apparatus of claim 1, wherein the web moving means comprises a pressure means movable in a direction for engaging one of the webs and for moving it against the other web for effecting the splicing.

3. The apparatus of claim 2, wherein the pressure means is positioned to contact the trailing end of the first web and to move that to the leading end of the second web to effect the splice between the first and second webs.

4. The apparatus of claim 3 wherein the pressure means comprises a pressure roll over which the first web is moved and the pressure roll being selectively movable to the splice position and away therefrom.

5. The apparatus of claim 4, wherein the extension extends downstream from the suction box and past the splice position.

6. The apparatus of claim 1, wherein the extension extends downstream from the suction box and past the splice position.

7. The apparatus of claim 6, further comprising a means to apply pressure to sections of the first and second webs to be spliced, and wherein the extension is deflectable along with the movement of the pressure means over an angle of deflection of the extension toward and away from the splice position.

8. The apparatus of claim 7, wherein the extension is deflectable over an angle that is a maximum of 15°.

9. The apparatus of claim 7, wherein the extension comprises a leaf spring of essentially constant thickness in the range between 0.3 and 0.7 mm and the leaf spring is comprised of resilient metal normally biased toward the pressure means.

10. The apparatus of claim 9, wherein the leaf spring is of a width to extend essentially the width of the webs.

11. The apparatus of claim 1, further comprising a cantilever support on the downstream end of the suction box for the extension and support means on the cantilever support and on the extension for supporting the extension to the cantilever support, for the extension to extend downstream of the suction box in the direction of web movement from the cantilever support.

12. The apparatus of claim 11, wherein the support means of the extension to the cantilever support comprises a tongue formed by a portion of the leaf spring depressed at an angle from the leaf spring and a wedge piece adapted for engaging the tongue and means for attaching the wedge piece over the tongue for supporting the tongue to the cantilever support.

13. The apparatus of claim 12, wherein the cantilever support has a slot therein in which the tongue extends and in which the wedge piece is secured for securing the tongue to the cantilever support, the slot being oriented for fastening the extension to the cantilever support in the direction of the plane of the extension.

14. The apparatus of claim 12, wherein the cantilever support of the suction box comprises an extension from the suction box extending downstream thereof and the extension being supported at the downstream extended part of the suction box.

15. Apparatus for stabilizing a moving web, comprising:

a suction means arranged between a threading point of a web and a distant position lying in a web-run direction ahead of the threading;

the suction means including a suction surface adjacent to the web for stabilizing the web as it moves;

at least a leaf-spring-like extension of the suction surface extending in the direction towards the threading point and being deflectable toward the web; and the suction means and leaf-spring-like extension being for stabilizing the web as it moves.

16. The apparatus of claim 15, wherein the at least a leaf-spring-like extension has a width extending essentially the width of the web.

* * * * *